United States Patent [19]

Hough

[11] 3,997,925

[45] Dec. 21, 1976

[54] APPARATUS TO CONTROL THE WATER LEVEL IN A SWIMMING POOL

[76] Inventor: William D. Hough, 2611 Poinsettia Drive, McKeesport, Pa. 15131

[22] Filed: May 21, 1975

[21] Appl. No.: 579,315

[52] U.S. Cl. ..... 4/172.17; 4/172; 137/426; 137/428

[51] Int. Cl.[2] ..... E04H 3/16; E04H 3/18; F16L 21/02

[58] Field of Search ..... 4/172, 172.15, 172.17, 4/172.18; 137/412, 428, 426

[56] References Cited

UNITED STATES PATENTS

| | | | |
|---|---|---|---|
| 1,820,981 | 9/1931 | Fever | 4/172.17 |
| 2,707,482 | 5/1955 | Carter | 4/172.17 |
| 2,739,939 | 3/1956 | Leslie | 4/172.17 X |
| 3,386,107 | 6/1968 | Whitten, Jr. | 4/172.17 |
| 3,739,405 | 6/1973 | Schmidt | 4/172.15 |
| 3,759,286 | 9/1973 | Page | 4/172.17 |
| 3,908,206 | 9/1975 | Grewing | 4/172.17 |

*Primary Examiner*—Henry K. Artis
*Attorney, Agent, or Firm*—Brown, Murray, Flick & Peckham

[57] ABSTRACT

Apparatus to maintain the desired water level in a swimming pool includes a stilling chamber receiving pool water from an equalizer pipe connected to the pool essentially below the desired water level. The stilling chamber is located externally of the swimming pool at the same general elevation as the desired water level so that a water level detector in the stilling chamber will open a valve in a water supply line to supply make-up quantities of water to the swimming pool to maintain the desired water level therein. In one form, the detector includes a plurality of probes extending downwardly within a secondary stilling chamber member located within the main stilling chamber. A relay unit receives an electrical signal when the detected water level falls below a desired water level to open a solenoid-operated valve located in the water supply pipe. In the second embodment, a valve assembly in the stilling chamber is mechanically operated by a float connected by a control arm to the valve assembly.

8 Claims, 5 Drawing Figures

APPARATUS TO CONTROL THE WATER LEVEL IN A SWIMMING POOL

BACKGROUND OF THE INVENTION

This invention relates to an apparatus to maintain the water level in a swimming pool at a desired elevation, and more particularly, to such an apparatus which will provide an automatic control of valve means in a water supply line so as to accurately supply make-up quantities of water to the swimming pool to maintain the water level within predetermined limits.

In the usual swimming pool construction, filtered water enters the pool through nozzle assemblies passing through the pool walls; while the main drain returning water to the filtering equipment is at the bottom of the pool. In addition to the main drain it is also necessary to provide an overflow gutter or skimmer system around the periphery of the pool to "skim off" surface water and return it to the filtering unit since this surface water contains most of the contaminants such as bacteria, oil and debris.

An example of a gutter and water supply system for a swimming pool is disclosed in my prior U.S. Pat. No. 3,641,594 wherein a gutter is provided with a removable slotted cover and the water supply conduit is carried within the gutter itself. In order that an overflow system extending about the upper periphery of the pool will function in its intended manner, it is necessary that the water level within the swimming pool should be kept within a narrow range. It is virtually impossible to accurately maintain the desired water level in the swimming pool, particularly when the swimming pool is in use, by manually operating a control valve to supply make-up quantities of water. There is, of course, the danger that the swimming pool may be overfilled which could only be detected after the overflow gutter or skimmer system was completely flooded. An abnormally low water level in the pool will cause a failure to supply sufficient quantities of water from the skimmer system to the filter system.

SUMMARY OF THE INVENTION

It is an object of the present invention to provide an apparatus to automatically maintain a desired water level in a swimming pool within predetermined limits.

It is another object of the present invention to provide an apparatus to automatically maintain a desired water level in a swimming pool by providing a stilling chamber to detect the actual water level within the swimming pool at a remote location so that turbulence and fluctuations to the water level in the pool will have substantially no adverse effect upon detector means arranged in the stilling chamber to control the supply of make-up quantities of water.

In accordance with the present invention there is provided apparatus to maintain the water level in a swimming pool at a desired elevation within the predetermined limits along the side or end walls surrounding the periphery of the swimming pool, the apparatus including, in combination, a stilling chamber supported externally of the swimming pool at the same general elevation in a manner to include the predetermined limits to the desired water level therein, the stilling chamber having side walls to define a chamber height situated at the same elevation and greater than the distance between the predetermined limits to the desired water level in the swimming pool, an equalizer pipe extending in open communication between the stilling chamber and the water contained by the walls of the swimming pool at an elevation essentially below the desired water level to thereby maintain the same water level in both the stilling chamber and the swimming pool, a water supply pipe including valve means to control the flow of make-up quantities of water into the swimming pool, and detector means at the desired pool water level in the stilling chamber to control the vale means in a manner to maintain the water level in the swimming pool at the desired elevation.

In one form of the present invention, the detector means comprises a float member coupled by a control rod to the valve means situated in the stilling chamber at an elevation such that the valve means are operated to supply make-up quantities of water when the float means effectively falls below the desired elevation for the water level in the swimming pool.

The detector means in a second form includes a secondary stilling chamber member extending within the stilling chamber to support sensing probes at an elevation corresponding to the desired water level in the swimming pool whereby a lowering of the pool water is automatically detected by the probe means to provide an electrical signal for a relay unit used to energize a solenoid valve coupled in the water supply pipe.

These features and advantages of the present invention as well as others will be more readily understood when the following description is read in light of the accompanying drawings, in which.

Figure 1:
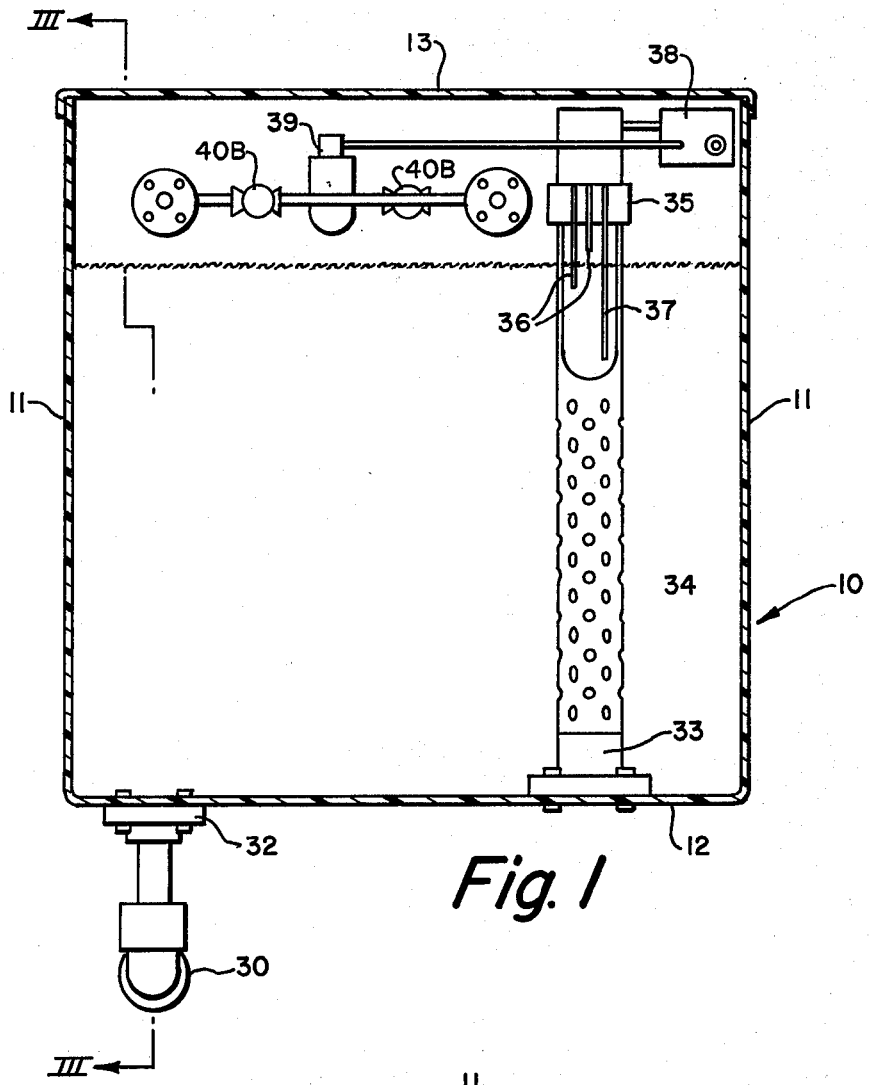
FIG. 1 is an elevational view of a main stilling chamber including one form of apparatus for maintaining the desired water level in a swimming pool according to the present invention.
Figure 2:
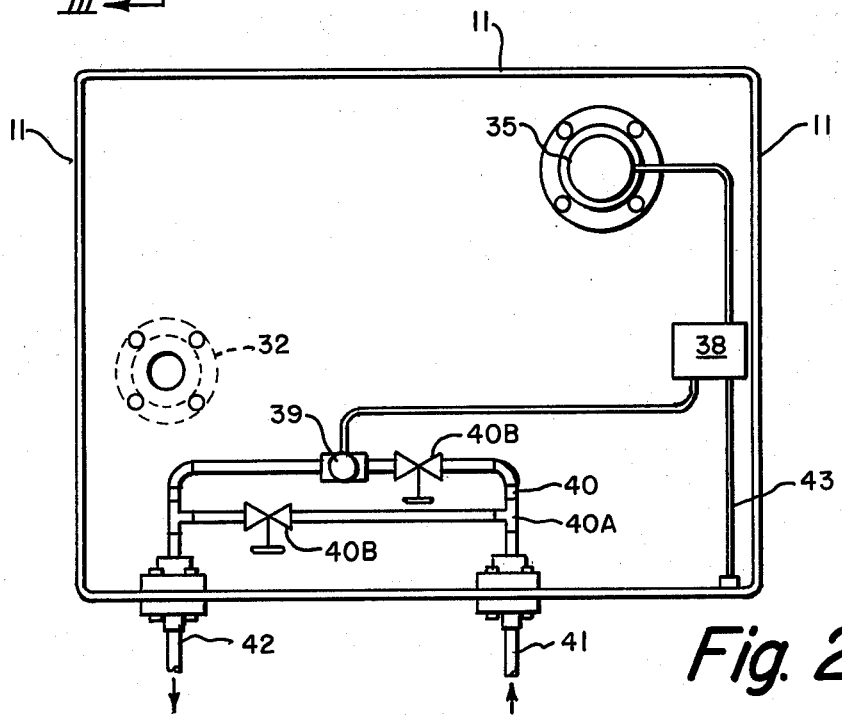
FIG. 2 is a plan view of the stilling chamber apparatus shown in FIG. 1.
Figure 3:
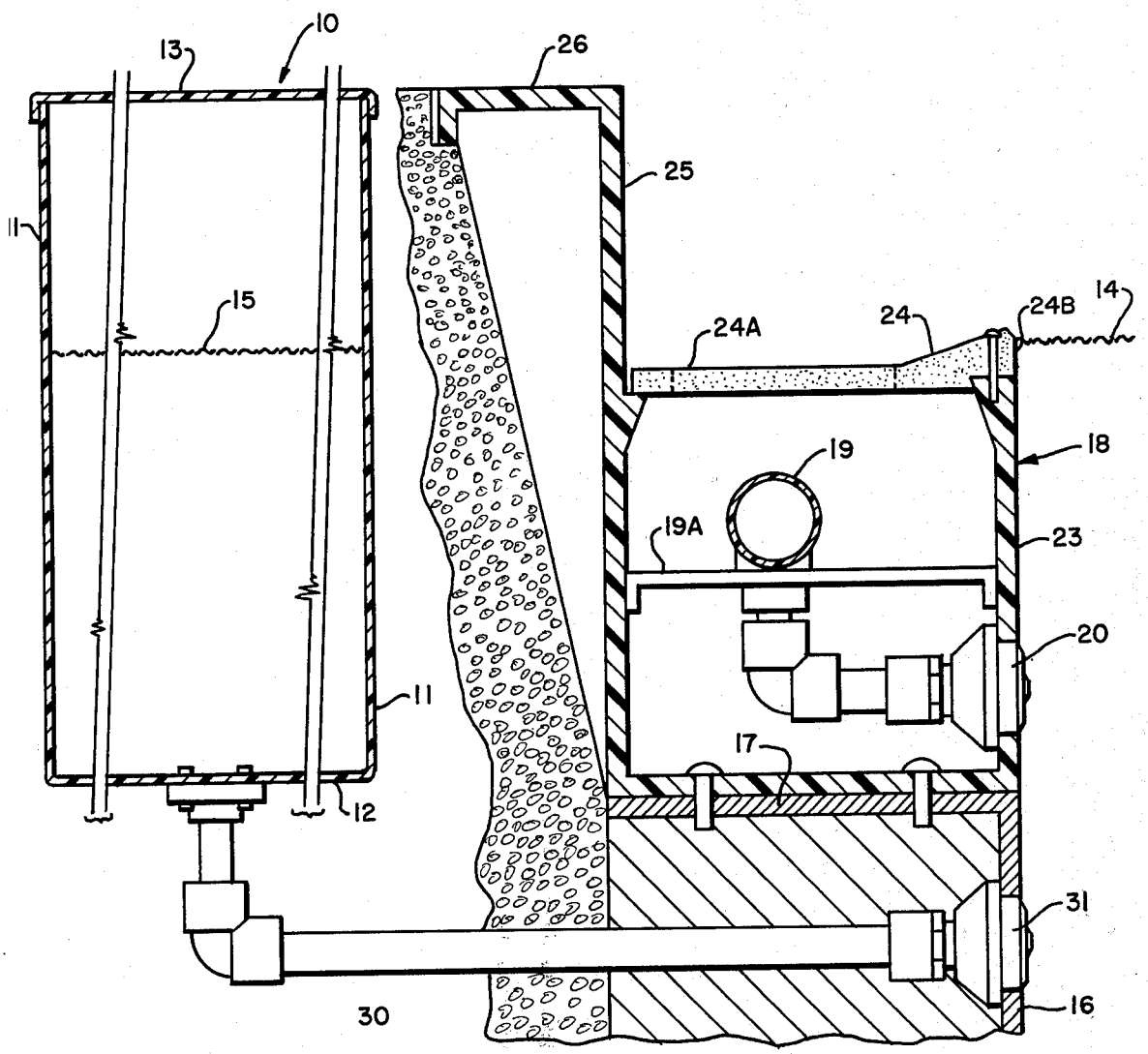
FIG. 3 is a sectional view taken along line III—III of FIG. 1.

In FIGS. 1–3, there is illustrated a stilling chamber 10 having upstanding side walls 11 integral with a floor wall 12. A removable lid 13 normally closes the top of the stilling chamber which is situated at a remote location to the swimming pool. In accordance with the present invention, the height of the stilling chamber defined by its side walls 11, extends through the same elevation as the elevation corresponding to the desired water level for the swimming pool. It is preferred that the stilling chamber extends from a ground level elevation to approximately two feet below the desired water level of the swimming pool which is generally indicated in FIG. 3 by reference numeral 14 in respect to the swimming pool and by reference numeral 15 in respect to the stilling chamber.

As shown in FIG. 3, the swimming pool includes a side wall 16 having a top flange 17 secured thereto. The wall 16 and top flange 17 extend about the entire periphery of the swimming pool and support a gutter assembly 18. A filtering unit supplies filtered water to a water supply conduit 19 that is supported by hanger bars 19A in the gutter assembly. The supply conduit 19 is connected at spaced points along its length about the periphery of the pool to inlet nozzle assemblies 20 which feed the filtered water into the pool. Scupper slots are typically formed in the forward wall 23 of the gutter assembly to provide continuous flow into the cavity of the pool water in the event the water level drops below the normal line level 14. Covering the upper open end of the gutter assembly and supported thereby is a plurality of removable slotted overflow gutter caps 24 that are placed in an end-to-end relation to extend about the periphery of the swimming pool. The slotted openings 24A in each cap 24 pass the water into the gutter assembly which flows over a forward lip 24B. The water collected in the gutter assembly is delivered by pipes, not shown, to a filter system and then returned to the swimming pool via nozzle assemblies 20.

The gutter assembly is provided with an upstanding portion 25 that extends up to a top deck section 26 located at an elevation that preferably coincides with the elevation of the removable lid 13 of the stilling chamber 10. An equalizer pipe 30 extends through the wall 16 of the pool wherein it is coupled to a nozzle 31 for conducting the pool water through the equalizer pipe 30 into the stilling chamber 10. The equalizer pipe is coupled by a flange 32 that surrounds an opening in the bottom wall 12 of the stilling chamber. The bottom wall 12 supports a vertically-extending secondary stilling chamber member 33 having perforated openings 34 in the wall thereof for the passage of water into the interior of the secondary stilling chamber member so that the water level therein corresponds to the water level in the stilling chamber as well as the pool.

The upper edge of the secondary stilling chamber member supports a probe housing 35 having a plurality of probes 36 extending downwardly within the secondary stilling chamber member to different elevations which define an upper and lower limit to the desired water level in the swimming pool. The probe housing also supports a ground probe 37 that extends downwardly in the stilling chamber member substantially below the probes 36. The electrical potential of each of the probes 36 is reduced to ground potential when they become submerged in the water which, in this instance, forms an electrical coupling to the ground probe 37. An electrical signal is thereby produced and delivered to a relay unit 38. The relay unit 38 controls a solenoid-operated valve 39 in a water supply pipe 40 that is, in turn, connected to a source of suitable water to supply make-up quantities of pool water. The water supply pipe 40 is actually branched by a tee 40A and each branched pipe includes a manual turn-off valve 40B that can be separately used to control the flow of water into the swimming pool by a discharge pipe 42.

The pipes 40 and 42 pass through openings in the side wall of the chamber where flanged couplings are used to form a water-tight seal. A water-tight conduit 43 contains electrical lines and extends between the relay unit 38 and the side walls of the stilling chamber. It will be understood by those skilled in the art that the probe housing 35 may be raised or lowered relative to the secondary stilling chamber member in a manner to adjustably position the probes 36 in a manner to define the limits for the desired water level that is to be maintained within the swimming pool.

Figure 4:
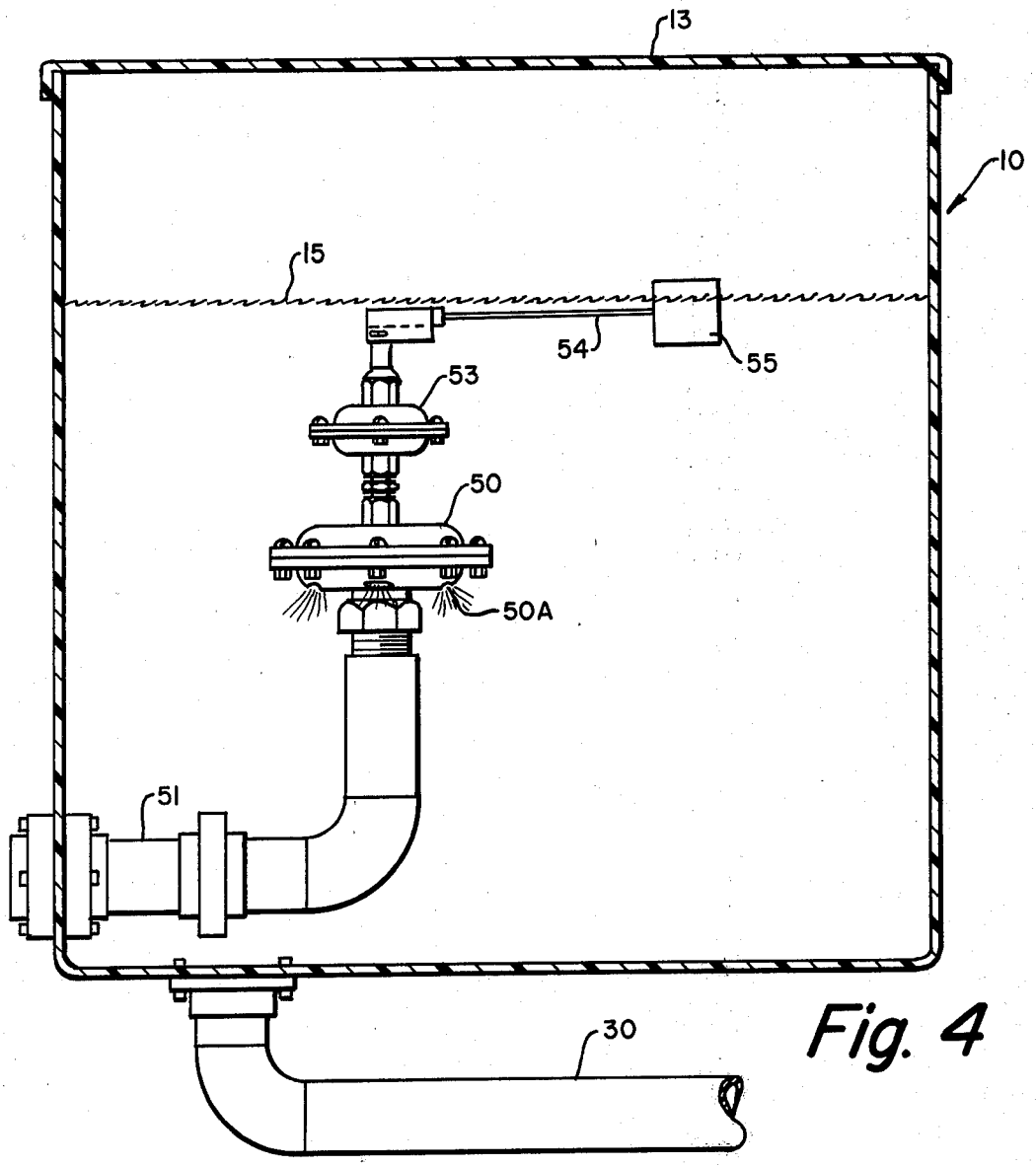
FIG. 4 is an elevational view of a second form of stilling chamber according to the present invention to maintain the desired water level in a swimming pool.
Figure 5:
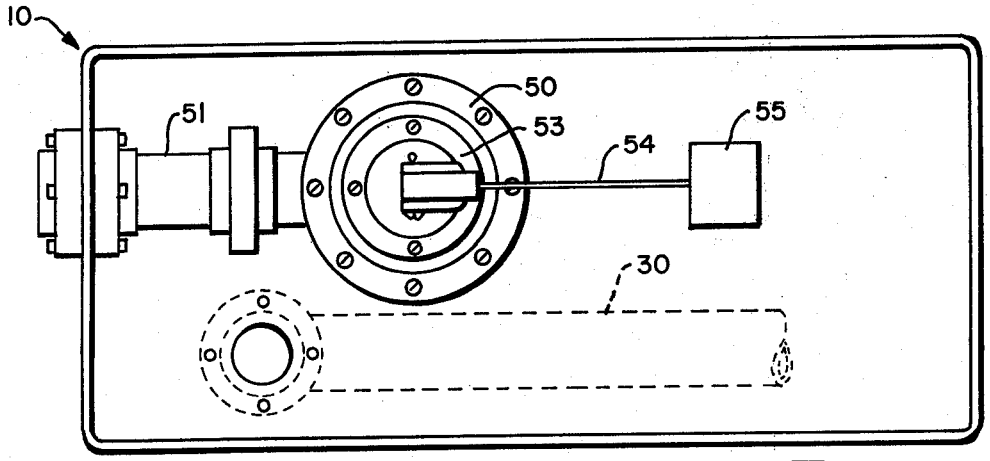
FIG. 5 is a plan view of the apparatus shown in FIG. 4.

With reference now to FIGS. 4 and 5, there is illustrated a further embodiment of the apparatus for maintaining a desired water level in a swimming pool which differs essentially from that previously described in regard to FIGS. 1–3 by providing a mechanically-operated valve assembly 50 in the stilling chamber 10. The valve assembly is connected by a pipe 51 and a flange connection 52 to a suitable water supply for providing make-up quantities of water which flows through the pipe 51 into the valve assembly 50 and thence through openings 50A in the valve housing. The valve 50 is mechanically actuated by a push rod extending through an auxiliary housing 53 and connected to one end of a control arm 54 that carries on its opposite end a float 55. The float 55 is positioned by the control arm 54 and designed in such a manner that when the water level within the settling tank is at an elevation corresponding to the desired water level in the swimming pool, then the float maintains the valve 50 in a closed position. As the water level falls within the stilling chamber, the float automatically opens the valve until sufficient quantities of make-up water have been introduced into the stilling chamber which then flows through the equalizer pipe 30 into the swimming pool until the water level in the stilling chamber is restored to the desired pool water level at which time the float then terminates the discharge of water by the valve assembly 50.

Although the invention has been shown in connection with certain specific embodiments, it will be readily apparent to those skilled in the art that various changes in form and arrangement of parts may be made to suit requirements without departing from the spirit and scope of the invention.

I claim as my invention:

1. Apparatus to maintain the water level in a swimming pool at a desired elevation along the side walls surrounding the periphery of the swimming pool, said apparatus including, in combination:

a stilling chamber supported externally of the swimming pool, said stilling chamber having side walls to define a chamber height situated at the same elevation so as to include the elevation of the desired water level in the swimming pool, an equalizer pipe extending in open communication between said stilling chamber and the water contained by the walls of the swimming pool at an elevation essentially below the desired water level to thereby maintain the same water level in both the stilling chamber and the swimming pool, a water supply pipe including valve means to control the flow of make-up quantities of water into the swimming pool, detector means at the desired pool water level in said stilling chamber to control said valve means in response to the detected water level therein in a manner to maintain the water level in the swimming pool at the desired elevation, said detector means including a secondary stilling chamber member having a perforated wall supported in said stilling chamber, and probe means extending into said secondary stilling chamber member to an elevation coinciding with the desired elevation to the water level in the swimming pool.

2. The apparatus according to claim 1 wherein said stilling chamber includes a floor wall having an opening therein coupled to said equalizer pipe, the side walls of said stilling chamber having an opening therein for the delivery of make-up quantities of water into the stilling chamber for passage into the swimming pool through said equalizer pipe.

3. The apparatus according to claim 1 further comprising a removable lid supported by the side walls of said stilling chamber, said swimming pool including decking extending about the upper periphery of the swimming pool walls, said decking and said removable lid being spaced from each other and lying at approximately the same elevation.

4. The apparatus according to claim 1 wherein said water supply pipe extends through a side wall of said stilling chamber and said valve means is coupled to the water supply pipe within the stilling chamber.

5. The apparatus according to claim 1 wherein said probe means are further defined to include a plurality of probe members extending to different elevations in said secondary stilling chamber member in a manner to define the predetermined limits to the desired water level in the swimming pool.

6. The apparatus according to claim 5 wherein said probe means includes a probe at ground electrical potential extending to an elevation below said plurality of probe members.

7. The apparatus according to claim 6 wherein said detector means includes a detector relay responsive to a ground potential signal from at least one of said plurality of probe members to control said valve means.

8. The apparatus according to claim 7 wherein said valve means includes a solenoid valve.

* * * * *